US006435963B1

(12) United States Patent
Dill

(10) Patent No.: US 6,435,963 B1
(45) Date of Patent: Aug. 20, 2002

(54) BARRIER DEVICE TO SURROUND AIR DELIVERY STRUCTURES

(76) Inventor: W. Larry Dill, 646 Tomoka Farms Rd., New Smyrna Beach, FL (US) 32168

( * ) Notice: Subject to any disclaimer, the term of this patent is extended or adjusted under 35 U.S.C. 154(b) by 0 days.

(21) Appl. No.: 09/750,553

(22) Filed: Dec. 28, 2000

(51) Int. Cl.[7] ..... F24F 13/06
(52) U.S. Cl. ..... 454/292; 454/300; 454/306
(58) Field of Search ..... 454/292, 299, 454/300, 306, 307, 330

(56) References Cited

U.S. PATENT DOCUMENTS 2,734,446 A * 2/1956 O'Day
3,386,367 A * 6/1968 Pellegrino
3,502,016 A * 3/1970 Steele
4,655,120 A 4/1987 Lemmo
4,858,520 A 8/1989 Prochnow et al.
5,001,968 A 3/1991 Sodec et al.
5,003,867 A 4/1991 Sodec et al.
5,042,567 A * 8/1991 Kajimoto et al.
5,211,605 A 5/1993 Shiga et al.
5,236,391 A 8/1993 Schaefer
5,657,636 A 8/1997 Suggs
5,778,147 A 7/1998 Kim

* cited by examiner

*Primary Examiner*—Harold Joyce
(74) *Attorney, Agent, or Firm*—Van Dyke & Associates, P.A.; Timothy Van Dyke; Joseph Fischer

(57) ABSTRACT

Devices, methods of using the devices, and kits are described that provide a protective barrier device between an air delivery structure of an air conditioning unit and the ceiling components that are adjacent to the air delivery structure. The device is a unitary water-impermeable structure having surfaces that act as barrier, preventing condensation collecting on the air delivery structure from passing to the sorrounding ceiling components. A preferred embodiment of the invention has a surface projecting into the space being cooled, said surface deflecting air from the adjacent ceiling structures, thereby reducing or preventing collection of dirt or other particles, or moisture, from depositing on the adjacent ceiling components.

23 Claims, 8 Drawing Sheets

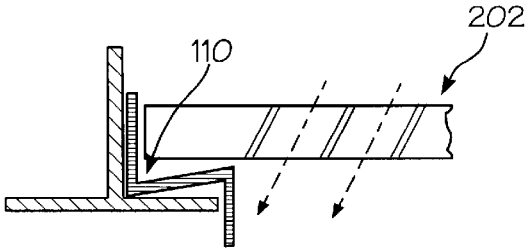
Fig. 5A
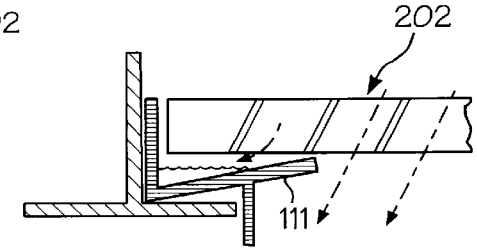
Fig. 5B
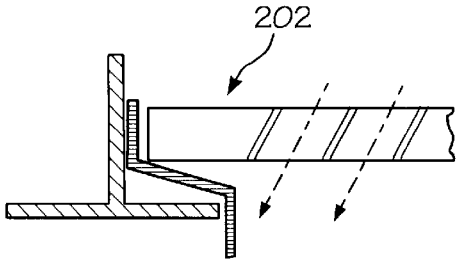
Fig. 5C
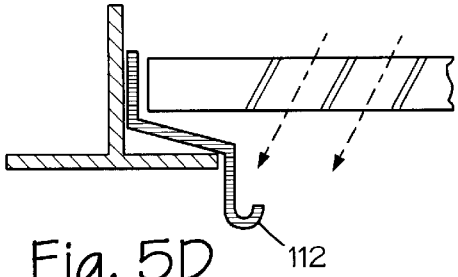
Fig. 5D
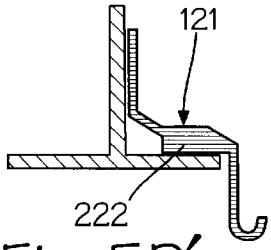
Fig. 5D′
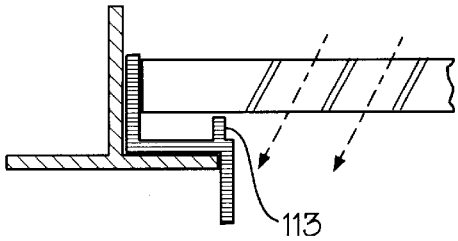
Fig. 5E
Fig. 5E′
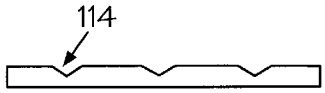
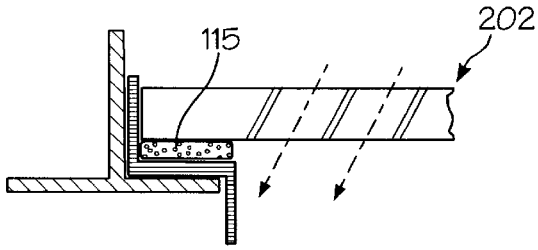
Fig. 5F
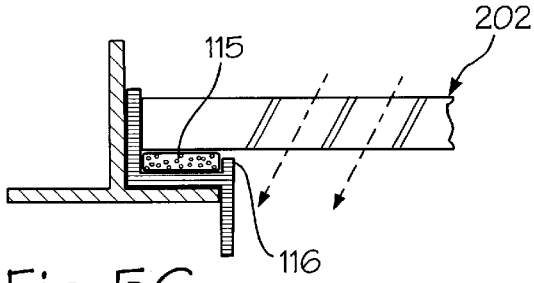
Fig. 5G

BARRIER DEVICE TO SURROUND AIR DELIVERY STRUCTURES

FIELD OF THE INVENTION

This invention relates to the protection from the effects of air-outflow from an air-conditioning airflow structure. More particularly, this invention relates to the field of protecting ceiling tiles, and other ceiling components that surround an air diffuser, from damage due to moisture, dirt, dust, grease and other particulates that may emanate from the diffuser and its connecting components.

BACKGROUND OF THE INVENTION

The art of directing air flow into defined enclosed spaces, such as rooms in buildings, aircraft compartments, ship compartments, and the like, employs a variety of designs and technologies used in a wide range of conditions. A common system employs rigid or flexible ductwork directing air from a source of pressurized air (such as a heating or air conditioning unit) through one or more air inflow structures into the defined spaces. A connecting means typically connects the outflow end of a flexible duct to the diffuser, which typically comprises a boot structure integral with a grill device that directs air into a room. Depending on the insulation properties of the boot, and the ambient humidity, condensate may form on its exterior surface and travel downward to the edges of the diffuser structure.

The final air delivery structure directing air into the defined space, from a ceiling, is referred to, among other terms, as a diffuser, register, or supply grill. For the purposes of this specification, this will be referred to as a diffuser to represent the variety of possible air delivery structures that direct air into a room from a ceiling surface. For purposes of this invention, this term represents, and is interchangeable with, the term "air delivery structure". These terms, diffuser and air delivery structure, include the combination of the boot and the actual grillwork connected to the grill that directs the air into the room.

It has been observed in some applications, such as restaurants, that one or more ceiling tiles immediately adjacent to a diffuser become stained due to having received moisture from water condensation from the boot, from the outer edges of the diffuser, or from both. This condensation collects and can travel to an adjacent tile, causing a stain. The stain is aesthetically displeasing, and may also harbor bacteria or molds that can contribute to air quality deterioration and 'sick building syndrome'. Additionally, the condensation has been observed to cause rust and other deterioration, such as loss of surface paint, on the suspended ceiling support grids immediately adjacent to the diffuser. In extreme conditions, the saturation of adjacent tiles may result in the tiles falling, causing injury to persons or equipment. Also, another extreme condition may be when a puddle forms from excessive condensation falling below the diffuser, possibly resulting in slip-and-fall type injuries to persons traveling below.

Another problem that has been observed is the noticeable depositing of dirt stains on ceiling tiles and other ceiling structures adjacent to a diffuser. This appears to be due to a combination of factors, including but not limited to at least some of the following: infrequent changing of air system filters; heavy load of particulates in the air leaving the diffuser; and the diffuser directing air near or onto the adjacent ceiling structures.

For these reasons, a simple, effective means of preventing this deterioration and risk of injury is needed. The present invention solves the problem of excessive condensate moisture collecting around or on diffusers, and does this in a simple and relatively inexpensive manner. The present invention, in preferred embodiments, also reduces or eliminates the deposition of staining material onto the adjacent ceiling structures from the diffuser outflow air.

Other devices are known that attempt to solve diffuser-related condensation problems. For instance, U.S. Pat. No. 5,657,636 teaches applying heat transfer tape around the perimeter of a concentric diffuser (e.g., a circular diffuser supplying cool air around the perimeter and drawing return air into the center portion). A humidistat positioned in the return side of the air conditioning unit, upon sensing an elevated humidity level, trips a relay to send current to the tape, heating the tape. The tape is said to heat the supply grill, thereby preventing moisture condensation accumulation.

In contrast, U.S. Pat. No. 5,211,605 teaches an air conditioner diffuser assembly constructed of molded inorganic fiber material cured with a binder. This material, having a low thermal conductivity, thereby prevents (or minimizes) condensate accumulation on this diffuser. One drawback to this invention is the need to replace existing diffusers with this specially fabricated diffuser. Where the existing diffusers are in good condition, this would appear wasteful of assets.

Another reference directed to solving the condensation problem using a different solution is U.S. Pat. No. 5,778,147. This patent teaches use of a heater to heat the grilles of an air discharge port of a room air conditioner.

The present invention solves the problems of moisture deterioration and staining of adjacent ceiling tiles, support grids, and other adjacent ceiling components. In addition, by preventing or reducing the exposure of ceiling tiles to moisture, the present invention reduces the likelihood of mold growth on such tiles. This is advantageous in light of recent concerns about mold and other microorganism growth in buildings, which has been shown in some cases to be causative or a contributing factor in 'sick building syndrome.'

SUMMARY OF THE INVENTION

The present invention provides an article of manufacture herein termed a barrier device, barrier means or protective device, and related methods and kits that protect ceiling tiles, ceiling support structures, and other ceiling components adjacent to an air delivery structure, herein also referred to as a diffuser, from exposure to moisture due to condensation at the edges of the air delivery structure. Embodiments of the invention also protect these ceiling components from deposition of dirt, dust, grease, moisture droplets, and other particulates being carried in the delivered air.

In one embodiment of this invention, a water-impermeable multi-faceted device is constructed to closely fit between the ceiling support structure and a diffuser whose external edges would otherwise contact the support structure. The device is comprised of at least two facets. An inner partition separates the side edges of the diffuser from the components of the ceiling support structure and/or the abutting ceiling tiles that lie immediately to the sides of the diffuser. A platform facet, integrally attached to the inner partition and substantially parallel to the ceiling plane, separates the lower-side edges of the diffuser from the underhanging ceiling support structure.

The inner partition and platform facets form a continuous, water-impermeable border around the diffuser, matching the outer shape of the diffuser (e.g., square, rectangular, circular, etc.). Condensation that collects on the inside faces of this device either remains there until it evaporates, or travels downward and away from the ceiling components. This protects the ceiling components from the degradative effects of condensation coming from the diffuser.

In another, preferred embodiment, the device additionally comprises a third facet, integral to and oriented below the interior end of the platform, projecting generally downward, away from the diffuser and toward the space receiving the air. This third facet is termed a deflecting partition; it serves to deflect air from passing close to or against the adjacent ceiling components. It has been observed in some air conditioning applications, such as in restaurants, that ceiling tiles adjacent to diffusers become noticeably dirty. This dirt comes from the diffuser, and often is related to high particulate levels in the air. The deflecting partition shields the adjacent ceiling components from nearby and direct airflow, and thereby prevents or minimizes the deposition of dirt, dust, grease, moisture droplets, and other particulates that are in the diffuser's air discharge.

The present invention, in other embodiments, incorporates the above-described features in newly designed diffusers rather than a separate barrier device. Additional objects, advantages, and novel features of the invention will be set forth in part in the description that follows, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

FIGS. 5A–G show cross sectional details of embodiments dealing with the handling of condensate in the present invention.

DETAILED DESCRIPTION OF THE INVENTION

According to the present invention, the foregoing and other objects and advantages are attained by providing the inventive arrangement of features either in the form of an inserted protective device around an existing diffuser, or by incorporating an inventive arrangement of features in a newly designed diffuser. The following descriptions illustrate a range of embodiments of the present invention.

For the purposes of this specification, the 'external edges' of an air delivery structure/diffuser are defined to include both the side edges that are adjacent to the inner partition, and the lower-side edges that would contact the ceiling support structure if not separated by the platform. The ceiling support structure is comprised of that portion of the structural members, for example the grids of a suspended ceiling, which are positioned directly below, and bear the weight of, the air delivery structure. Additionally, it is noted that each term in the following term pairs is interchangeable with the other term in that pair: inner partition and upward sealing edge; platform and horizontal sealing edge; and deflecting partition and downward sealing edge.

Figure 1A:
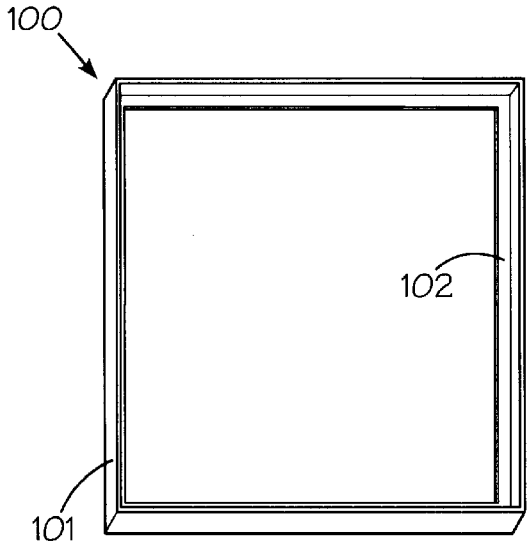
FIGS. 1A, B, C show perspective, top and side views of one embodiment of the invention that fits between the ceiling structure and a diffuser, and that comprises an inner partition integrally attached to a platform.
Figure 1B:
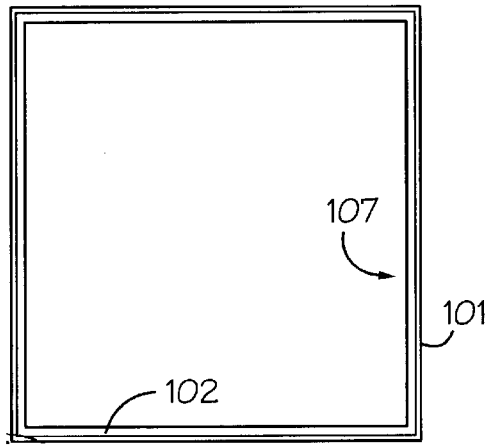
Figure 1C:
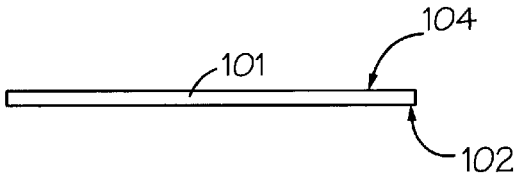

Referring to FIG. 1, a basic embodiment of the present invention, the protective device, or barrier device, 100, has an overall shape that conforms to the outside perimeter of the diffuser that the invention is to surround, in this example square. Typical diffuser shapes are square, rectangular and circular; the protective device of this invention can be made to surround these and other shapes. The facet positioned most interior in the ceiling, directed away from the space receiving the air, is the inner partition, 101. The inner partition is in a substantially perpendicular orientation to the plane of the ceiling, and has an upper edge, 104, that preferably is at least as tall as the external edges of the diffuser, which lie internal and adjacent to the inner partition when the device is properly installed.

Integrally attached at or near the bottom of the inner partition is the platform, 102. This connects to the inner partition at a mating junction that extends the entire perimeter of the structure, 100. The integral attachment preferably is achieved by a unitary molding of these facets, such as by injection molding of a water-impermeable plastic material. Such plastic material preferably has a low thermal conductivity coefficient so as to minimize the possibility of condensation forming on the non-diffuser side of the device.

The platform, 102, is substantially horizontal to the plane of the ceiling and has an exterior edge, that edge most distant from the center of the diffuser, which extends to or beyond the mating junction with the inner partition. At least some portion of the platform, typically the bottom side or a downward protrusion thereof, contacts and is supported by the ceiling support structure adjacent to the diffuser. The interior edge, 107, of the platform 102 extends inward, toward the center of the diffuser, at least as far inward as the interior edge of the surrounding ceiling support framework. This inward extension generally prevents condensate which collects on the upper portion of the platform from wicking onto and wetting the surrounding ceiling support framework. As necessary for a particular application, the inner edge of the platform can be angled, grooved on the underside surface, or otherwise shaped to avoid the condensate flowing or wicking onto the ceiling support framework. FIGS. 7A–D provides several examples of possible inner edges, shown in cut-away cross section views. These are meant to be illustrative and not limiting.

To install the protective device around a diffuser already installed, the diffuser is lifted from its seated position in a diffuser receptacle space on the ceiling support framework. Then a unitary barrier device according to this invention is placed into the diffuser receptacle space and slipped over and seated onto the ceiling support framework. Then the diffuser is returned to its normal position, now however having the protective device of this invention in place as a physical barrier between its edges and the ceiling tiles, ceiling support structure, and any other ceiling components. Installation in systems under construction simply requires insertion and seating of the device into the cavity into which the diffuser will be placed, and then placing the diffuser into the device. One embodiment of the present invention is a kit, containing installation instructions and at least one protective device according to the present invention. Another embodiment is a method of preventing condensation from contacting ceiling components adjacent to the air delivery structure, using embodiments of the protective device disclosed and claimed herein.

It is noted that for this embodiment and for other embodiments according to this invention, the preferred method of fabricating the invention is to form the facets in a single molding process to form the unitary device. However, the device according to this invention may also be formed by assembly of non-unitary segments, as by fitting one facet or section of a facet into an adjoining facet, and continuing assembly of such segments to form a unitary water impermeable device according to this invention. Methods known to those skilled in the art for joining segments together, such as gluing, locking joints, and so forth, may be used to form the non-unitary segments into a unitary water impermeable device according to this invention. Appropriate materials may be insulated or less thermally conductive metals, for instance aluminum, polymers, such as plastic polyethylene, polypropylene, and the like.

Figure 2A:
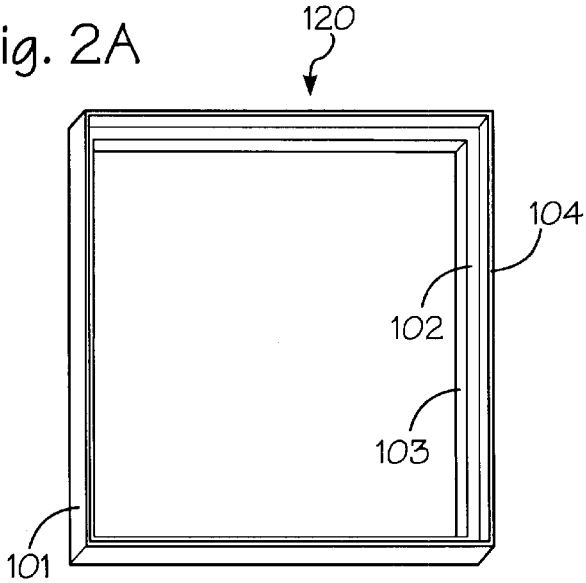
FIGS. 2A, B, C show perspective, top and side views of one embodiment of the invention that fits between the ceiling structure and a diffuser, and that comprises an inner partition, a platform, and a deflecting partition, all integrally attached.
Figure 2B:
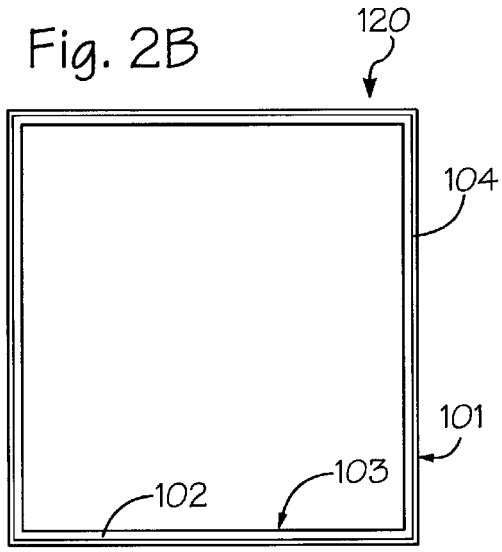
Figure 2C:
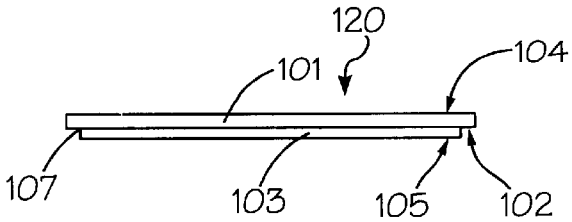

In a preferred embodiment of the present invention, shown in FIG. 2, the protective device, 120, has three integrally attached facets: the inner partition, 101, as described above, the platform, 102, and a deflecting partition, 103. The deflecting partition attaches, preferably at the inner edge as shown in FIG. 2, or alternatively on the platform's underside along a line more exterior from the platform's inner edge. The deflecting partition extends downward from the ceiling into the space receiving the airflow, and is oriented substantially perpendicular to the plane of the ceiling. Also shown in the side view of FIG. 2C are the upper edge of the inner partition, 104, and the lower edge of the deflecting partition, 105.

The primary effect of the deflecting partition is to divert airflow from the diffuser from the adjacent ceiling tiles and other ceiling components. It has been observed in some facilities, having air conditioning units in which either filters are inordinately dirty, particulate load in the air is high (such as in restaurants with many fryers), or both, the ceiling tiles adjacent to diffusers become noticeably dirty. A primary advantage of this embodiment is to prevent or minimize the airflow from flowing near or onto adjacent ceiling tiles and other ceiling components. This eliminates or reduces the deposition of dirt, dust, grease, moisture droplets, and other particulates in the airflow from depositing onto and forming visible marks on these ceiling components. It is noted that the attraction of nearby particulates to the ceiling tiles may be partly attributable to electrostatic and physicochemical forces, so that particulates in air flowing near, rather than across the tiles, nonetheless may deposit onto the tiles. Elimination or reduction of such deposition is accomplished by the redirecting of airflow due to the deflecting partition.

Figure 3A:
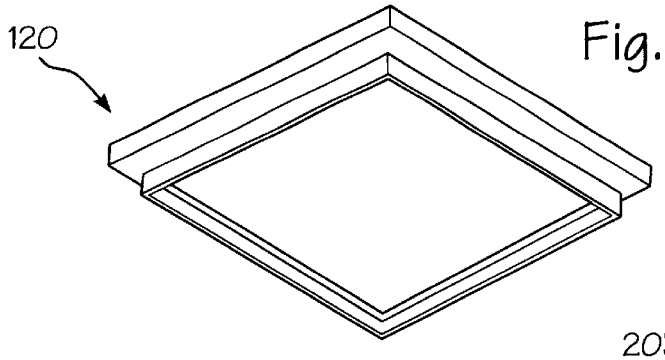
FIGS. 3A, B, C show perspective view of barrier device shown in FIG. 2, a side view of the barrier device in FIG. 2 shown fitting between in a diffuser receptacle space in a ceiling structure as the diffuser and attached components are being lowered into it.
Figure 3B:
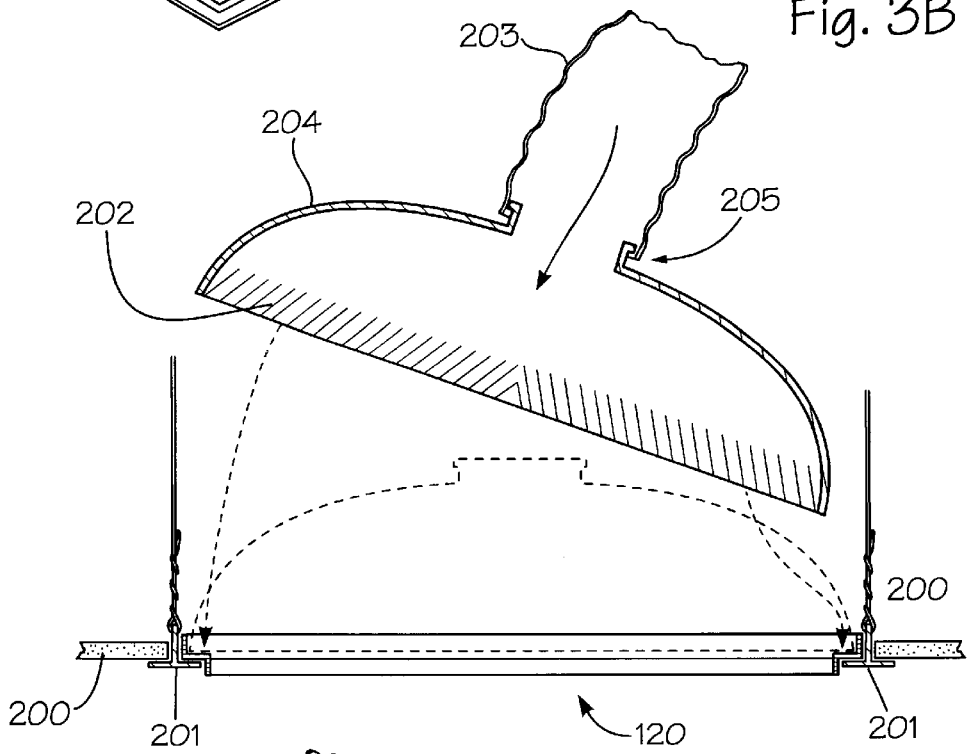
FIG. 3C shows the final orientation of the barrier device in place, with the diffuser within it.
Figure 3C:
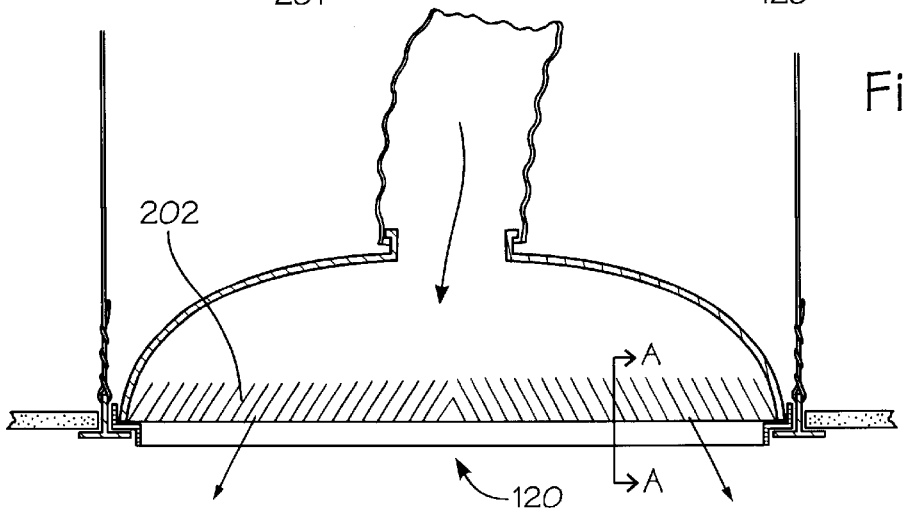

FIGS. 3A, B, C depicts the preferred embodiment 120 in FIG. 2 placed in a ceiling between a diffuser and the adjacent ceiling components. FIG. 3A shows a perspective of the barrier device, 120, in the general orientation for installation into a diffuser receptacle space in a ceiling. FIG. 3B side view diagram shows the barrier device in place in the diffuser receptacle space in the ceiling, with the diffuser, 202, an attached integral boot, 204, and connectable flexible ductwork, 203, being moved into position above the barrier device, 120. Here, ceiling tiles, 200, are shown supported by a ceiling grid support framework, 201. These surround the diffuser, 202. Air flows from an air conditioning unit (not shown) through the ductwork, 203, and through the boot, 204, which connects directly to the ductwork with a duct-to-boot connection, 205. The boot distributes the air across the diffuser, 202, which by vanes or other means directs the air into the space below in a particular pattern. FIG. 3C shows the final orientation of components in the diffuser receptacle space. The protective device, 120, fits between the grid support adjacent to the diffuser and the edges of the diffuser, preventing condensate from contacting the grid or the ceiling tiles, and deflecting air to keep dirty, particulate laden air from depositing on the adjacent ceiling tiles.

Figure 4:
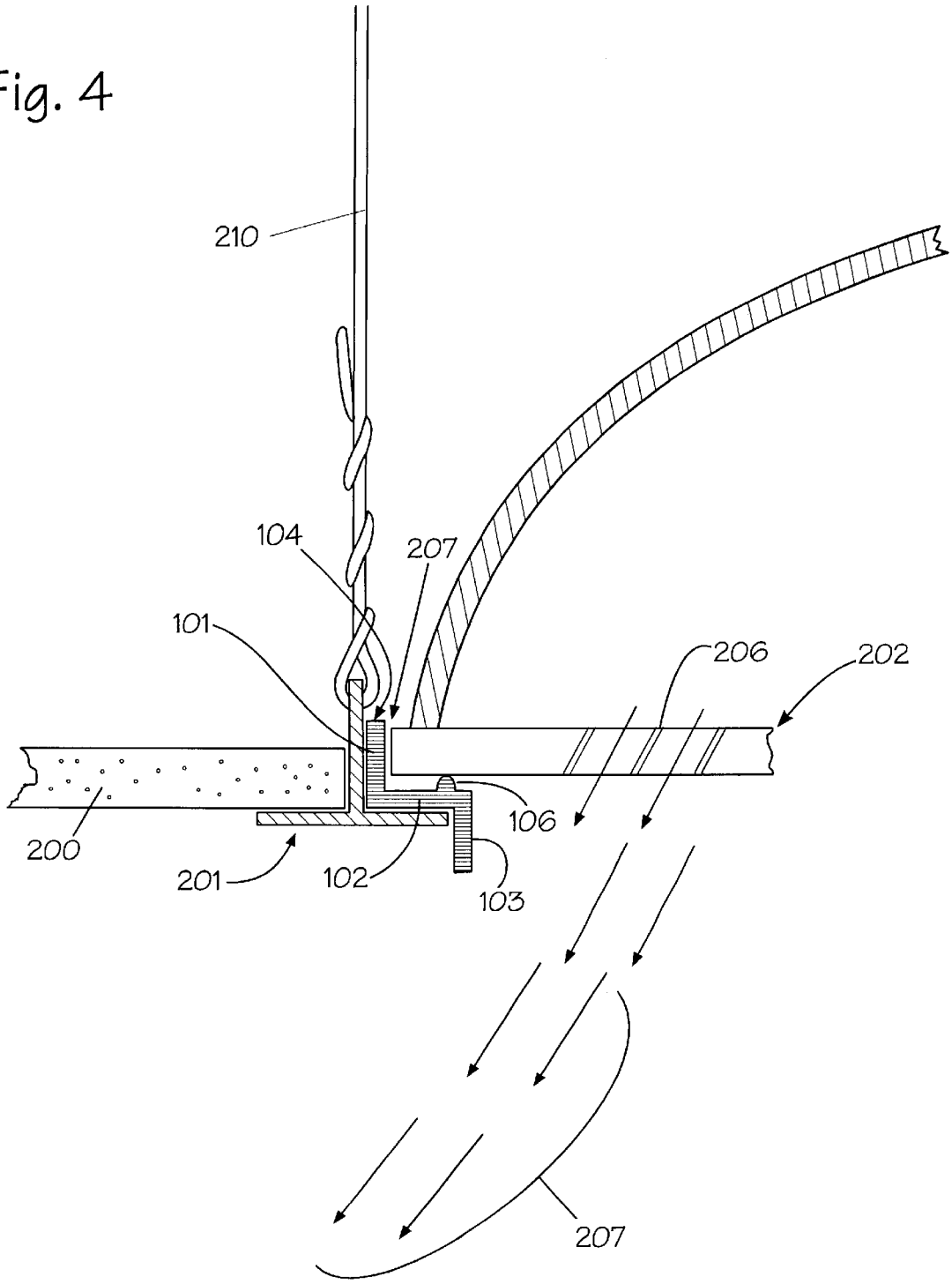
FIG. 4 is a cross-section close-up detail along the A-A axis of FIG. 3C.

FIG. 4 provides a cross section along the A-A axis of FIG. 3C. Air flowing through fixed vanes, 206, in the diffuser, 202, is shown leaving the diffuser by directional arrows, 207. Air encountering the deflecting partition, 103, is directed downward and laterally, away from adjacent ceiling tiles, 200, and the grids of the support framework, 201. The grids of the support framework, 201, are supported by support wires, one of which is shown as 210. The upper edge, 104, of the inner partition, 101, is shown extending above the top of the diffuser vertical edge, 207, of the diffuser, 202. This stops condensate from traveling laterally from the boot and diffuser onto the adjacent ceiling tiles, 200, and the grid support framework, 201.

It is noted that the conditions under which diffusers accumulate condensation vary considerably. Factors include: how effectively the air conditioning system dehumidifies; the humidity above the ceiling; the increase in humidity due to opening doors, etc. in the enclosed space; the humidity from persons and activities in the enclosed space. Once the condensation sweats onto or flows onto the protective device of the present invention, and begins to accumulate there, it can be disposed of by a number of means, partly depending on the expected conditions listed above. One additional factor is the daily cycling of humidity in the enclosed space and above the ceiling. For instance, one facility may have a low to moderate humidity load during the daytime, leading to limited condensation accumulating on the device during the daytime. This is followed by continued operation of the air conditioning system overnight while there is no activity in the cooled space, no additional humidity inputs, and a decrease in humidity in the system. This is a situation in which a basic embodiment of the present invention, such as shown in FIG. 1, is capable of handling the condensate. Condensate that accumulates during the day will have an opportunity to evaporate from the device during the evening hours, when the air conditioning system is reducing humidity.

For a set of conditions similar to the above but also having air flow nearby or directly across the ceiling adjacent to the diffuser, the embodiment shown in FIG. 2 is more appropriate. This embodiment, with a deflecting partition, would reduce or eliminate particulate deposition and staining.

However, in situations having greater condensation deposition, either intermittently or continuously, additional features of the present invention can better collect or retain a quantity of condensate, to aid in the evaporation of the collected condensate, or to otherwise dispose of the collected condensate. Therefore a range of embodiments are presented to deal in different ways with handling of condensate disposition. These embodiments are illustrative but not limiting as to possible approaches to condensate disposition according to the present invention.

In one line of embodiments directed to handle condensate, it is noted that when condensate collects on the top surface of the platform, a water film may form between this surface and the bottom surface of the diffuser edges if these surfaces are in close proximity. This filming, due to capillary action between the surfaces, could result in accumulation rather than evaporation or flow of the condensate. Therefore, in the preferred embodiment shown in FIG. 4, a spaced projection, 106, is shown rising from the top of the platform, 102. The spaced projections can be of various shapes, including but not limited to points or nubs, cleats, and longitudinal ridges or ribs. Preferably, the spaced projections project the same distance upward, thereby defining a generally flat line or plane to support the edges of the diffuser. One variation of the spaced projections is described in greater detail in the discussion of FIG. 6.

Another approach to handling condensate is shown in cross section side view in FIG. 5A. Here the area of the platform interior to the inner partition is angled upward from the point of connection with the inner partition. This forms a hollow, 110, in which condensate collects from the boot or edges of the diffuser. This accumulated condensate then evaporates during a period of non-accumulation of condensate. Alternately, where the installation allows, a drainage system can be connected to a low point in the hollow and the condensate is drained to a disposal point.

Another variation of this approach is to extend the inner edges of the platform sufficiently inward (depending on the design of the diffuser air flow pattern) so that these edges direct some incoming air across the hollow, to aid in the evaporation of the condensate collected therein. This extension, 111, is shown in FIG. 5B. For this and other embodiments, it is recognized that the edges of the platform may have flutings or other undulations to allow gaseous exchange across this edge. These may be needed where the diffuser bottom surface would otherwise form a tight seal with this edge.

Another approach to handling condensate is shown in cross section side view in FIG. 5C. Here the platform is angled downward from the inner partition, so that condensate flows toward the deflecting partition. Excess condensate then would flow down the deflecting partition and into the space below. Alternately, condensate could collect in an open channel, such as depicted in FIG. 5D, 112, at the bottom of the defecting partition. Here airflow would accelerate evaporation.

For the embodiments depicted in FIGS. 5A–D, it is noted that the diffuser's point of contact, 121 in FIG. 5D, with the diffuser may be broader than shown to provide a greater area of weight transfer. Also, any portion of the space shown beneath the point of contact may be filled, shown as 222 in FIG. 5D', in to provide greater strength to the device, in order to better support and transfer the weight of the diffuser.

Another approach to handling condensate is shown in cross section side view in FIG. 5E. Here, from the top surface of the inner edges of the platform, a wall, 113, projects upward. This wall extends continuously along all sides of the platform, forming a continuous contained space between it and the inner partition. In this space condensate may collect. As noted above, flutings or other partial breaks or openings in the wall, one example being depicted as 114, can be implemented to allow communication between both sides of the wall for gas exchange. Also, drainage means from a point of this space may be employed where appropriate.

Another approach to handling condensate is shown in cross section side view in FIG. 5F. Here a material, 115, is placed on the upper side of the platform to aid in the holding capacity and evaporative efficiency of the condensate. The material is of a class of materials having superior absorptive properties, so that condensate is readily taken up. The material also increases the surface area that has contact with air. This increases the evaporation rate. For purposes of this invention, this material is referred to as a "wicking material".

The wicking material also can be in a device according to this invention that has a wall structure, as shown in FIG. 5G. The wall, 116, need not be as high as the wicking pad when it is preferred that the wicking pad be in contact with the lower edges of the diffuser. In this way, the wall prevents excessive condensate from overflowing, while the wicking pad excess height provides a gap for gas exchange between the wicking pad and the air in the space being cooled. Alternately the wall can be higher than the wicking material, supporting the diffuser. In this case, the wall, as exemplified as 114 in FIG. 5E, can have fluting or other partial breaks or openings to allow gas exchange between the two sides of the wall. In these embodiments spaced projections, 106, are not necessary.

A further feature that can be applied with the wicking pad is the addition of agents to the pad to prevent or limit the growth of bacteria, molds, and other microorganisms. Bacteriostatic, bacteriocidal, mold inhibiting, mold killing, and other such agents known in the art may be applied to the wicking pad integrally during manufacture, or after wicking pad manufacture. This serves to reduce the chance of the collected condensate harboring bacteria, mold, and the like. Further, it is envisioned that these agents can be reapplied as needed while the protective device is installed and functioning.

Figure 6A:
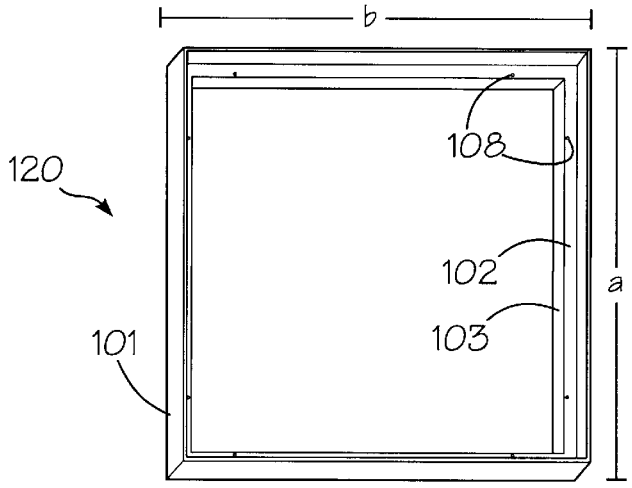
FIGS. 6A, B, C show perspective, top and side views of the embodiment shown in FIG. 2, with dimension lines to elucidate the dimensions of a preferred embodiment.
Figure 6B:
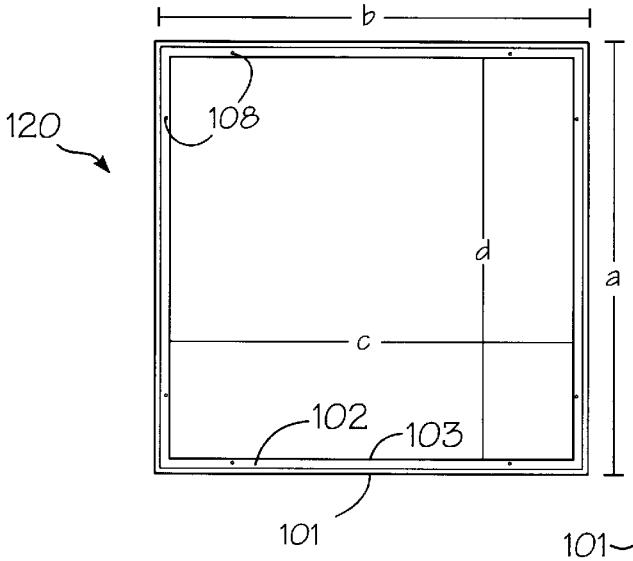
Figure 6D:
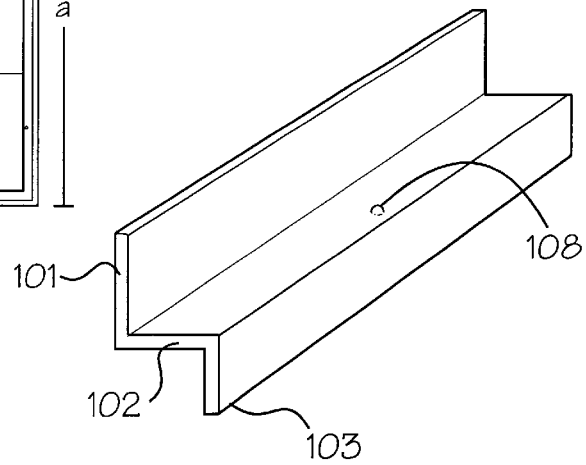
Figure 6C:
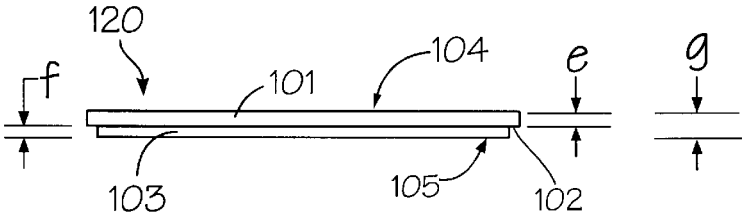
Figure 7A:
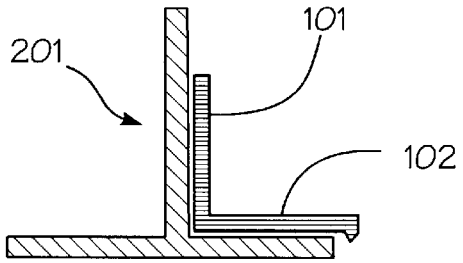
FIGS. 7A–D show cross sectional details of embodiments to prevent condensate from flowing under the platform in the embodiment shown in FIG. 1.
Figure 7B:
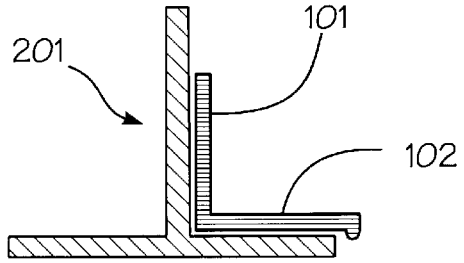
Figure 7C:
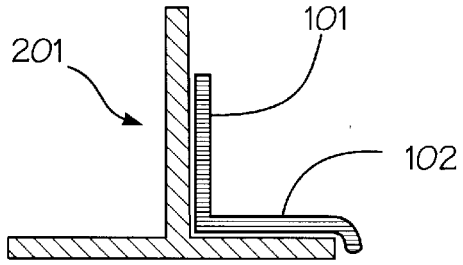
Figure 7D:
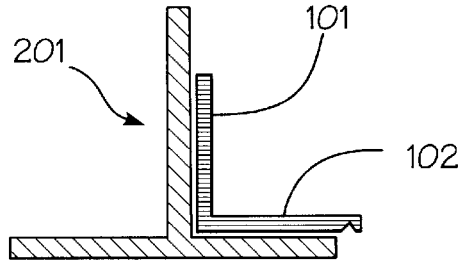

A preferred embodiment having specific dimensions for a common register size is represented in FIGS. 6A–D. The embodiment of the protective device, 120, fits around a nominal 24 inches by 24 inches diffuser. Referring to the perspective and top views, FIGS. 6A and 6B respectively, the outside overall dimensions, shown as a and b, are both 23.875 inches. Referring to FIG. 6B, the interior distances between opposing inner edges of the platform, 102, shown as c and d, are both 22.5 inches. Referring to the side view, FIG. 6C, the height, e, of the inner partition, 101, is 0.875 inches. The height, f, of the deflecting partition, 103, is 0.50 inches. Thus, the overall height, g, of the protective device is approximately 1.375 inches.

To fit into the space available, the thickness of the inner partition, 101, is approximately $1/16^{th}$ inch. The thickness of the deflecting partition, 103, is 1/8 inch. This preferred embodiment is molded as a single piece of clear plastic.

Also in this preferred embodiment are nub-like raised projections at spaced intervals along the upper face of the platform. These eight projections, 108, are 1/16 inch high and are spaced 4.625 inches from each corner. One such projection is shown in a close-up, FIG. 6D. Their purpose is to separate the lower edges of the diffuser sufficiently from the platform upper surface to prevent filming of the condensate between these surfaces.

Further, it is noted that in some embodiments it may be desirable to introduce projections from the interior surface of the inner partition, whereby such projections separate each edge of the diffuser from contacting any wall of the inner partition. This may be needed in certain applications, such as where the diffuser vertical edge height exceeds the height of the inner partition when set in place. The projections would provide space so that condensate does not travel over the top of one or more walls of the inner partition. Other purposes may also be achieved, such as assuring uniform flow of condensate down the inner walls of the inner partition, and to prevent filming of the condensate water between the inner partition and the vertical edge of the diffuser.

Figure 9A:
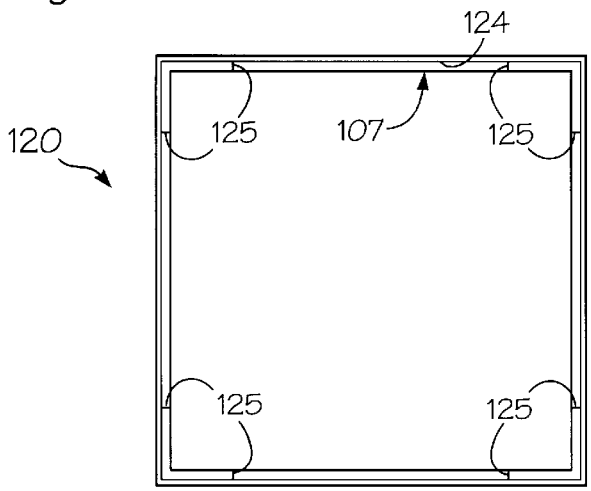
Figure 9B:
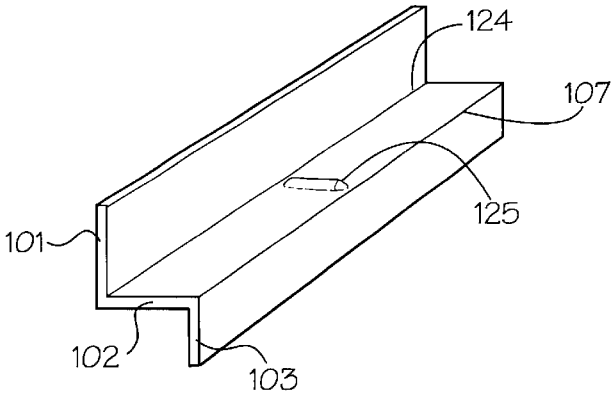
Figure 9C:
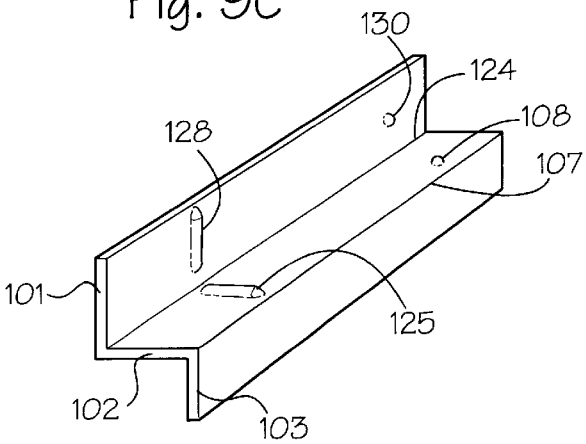

FIGS. 9A, B, C provide distance and close-up views of several forms of projections. FIGS. 9A and 9B show plan and close-up spaced projections in the form of ribs, 125. The ribs, 125, extend across the entire width of the surface between the mating junction, 124, of the inner partition, 101 and the platform, 102, and the inner edge of the platform, 107. FIG. 9C shows a side rib, 128, and a side nub, 130, situated on the interior surface of the inner partition, 101. As described in the preceding paragraph, projections such as these may be desirable to separate the inner partition, 101, from intimate contact with the external side edge of the air diffuser (not shown). A nub, 108, and a rib, 125, situated on the platform, 102, are also shown in FIG. 9C, to differentiate these features based on their respective shapes, and to distinguish from the side rib, 128, and the side nub, 130, based on respective positions on the barrier device.

Figure 8A:
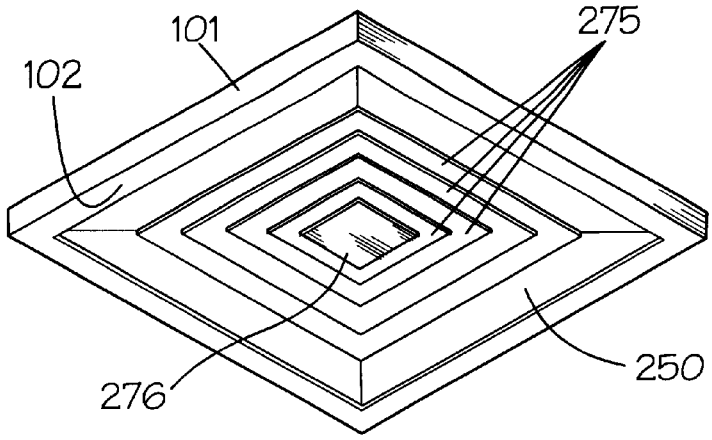
FIGS. 8A, B, C show depictions of variations of the invention combined integrally with a diffuser.
Figure 8B:
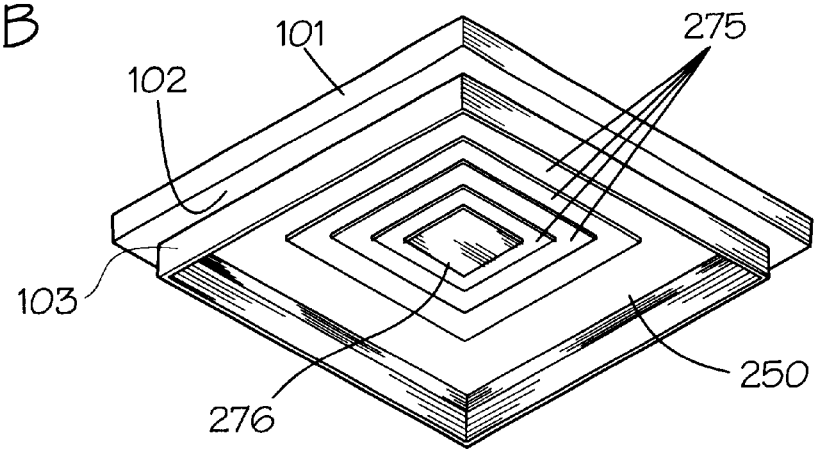
Figure 8C:
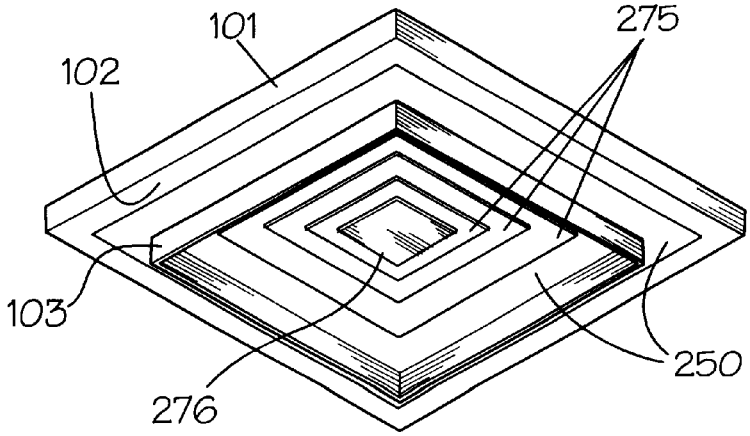

FIGS. 8A, B, C provide perspective views of variations of this invention wherein aspects of the barrier device are combined integrally with a new diffuser. An integrated combination of the diffuser with the features of the present invention allows the assembly or manufacture of new diffusers that protect surrounding ceiling structures from damage due to condensate transfer and/or accumulation of materials from airflow close to the ceiling. The integrated combination may be accomplished through an attachment of or an integration during manufacture of an existing barrier device according to this invention, with a diffuser. One example of this is depicted in FIG. 8A. Here the barrier device has two facets, the inner partition, 101, and the platform, 102. FIG. 8B depicts another variation wherein the third facet, the deflecting partition, 103, extends downwardly directly from the platform, 102. Alternatively, the placement of facets of this invention may be separated, such as in FIG. 8C. In FIG. 8C, the inner partition 101, is integral with the platform, 102, and both of these facets are separated from the deflecting partition, 103, which lies further inward on the downward-facing, outflow side of the integrated diffuser, 250. Also shown in FIGS. 8A–C are the vanes, 275, and the center plate, 276, of the diffuser, 250. It is also noted that the present invention may be combined, as exemplified above, not only with a diffuser as shown in the figures, but also, with the typical diffuser which comprises a boot structure integral with the grill device (shown as the diffuser in FIGS. 8A,B,C) that directs air into a room.

Therefore, the present invention provides for articles of manufacture, such as described herein, and the method of using these devices during operation of diffusers for air conditioning and heating. Regarding heating, it is noted that while condensation is not expected, the deflecting function of the embodiments with the deflecting partition will serve to protect structures adjacent to the diffuser from staining.

Having generally described this invention, including the best mode thereof, those skilled in the art will appreciate that the present invention contemplates the embodiments herein described, and equivalents thereof. However, those skilled in the art will appreciate that the scope of this invention should be measured by the claims appended hereto, and not merely by the specific embodiments exemplified herein.

What is claimed is:

1. A water-impermeable barrier device separating external edges of an air-conditioning unit's air delivery structure from adjacent components of a ceiling surrounding the air delivery structure, comprising:

a) an inner partition substantially perpendicular to the ceiling, having a top edge and a bottom edge, said inner partition surrounding the external edges of said air delivery structure; and b) a platform integral with said inner partition, said platform oriented substantially horizontal to the ceiling, comprising an exterior edge at or beyond a mating junction with the inner partition bottom edge, and an interior edge at or interior to a ceiling support structure supporting the air delivery structure, and an intermediate section spanning between the exterior and interior edges of the platform;

whereby the barrier device prevents condensate from the air delivery structure from contacting the ceiling support structure and other adjacent ceiling components.

2. The barrier device according to claim 1, additionally comprising a deflecting partition, integral with and extending downward from said platform, said deflecting partition positioned substantially perpendicular to said ceiling, whereby said deflecting partition deflects airflow to prevent dirt, dust, grease, moisture droplets, and other particulates in said airflow from depositing onto the adjacent components of the ceiling.

3. The barrier device according to claim 2, additionally comprising on a top side of the platform a plurality of spaced projections being shaped for defining a generally flat surface to support the external edges of the air delivery structure, preventing accumulated water from forming a film between said structure and said platform.

4. The barrier device according to claim 3, wherein the projections comprise nubs spaced apart from each other.

5. The barrier device according to claim 3, wherein the projections comprise ribs spaced apart and parallel to each other, running perpendicular to the interior edges of the platform.

6. The barrier device according to claim 2, wherein the platform interior to the inner partition angles upward from the mating junction, such that a hollow so formed collects condensate.

7. The barrier device according to claim 6, additionally comprising a means for collection and drainage of the condensate from the hollow.

8. The barrier device according to claim 6, wherein said platform extends sufficiently into the airflow from said air inflow structure to direct air into the hollow to evaporate the condensate.

9. The barrier device according to claim 8, wherein the distal edge of the deflecting partition additionally comprises an open channel that receives said condensate, whereby airflow upon the channel evaporates the condensate.

10. The barrier device according to claim 2, wherein the platform interior to the inner partition angles downward from the mating junction with the inner partition, such that said condensate flows to the deflecting partition.

11. The barrier device according to claim 2, additionally comprising a wicking pad positioned on the top side of the platform, interior to the inner partition, wherein the wicking pad receives the condensate and accelerates evaporation of the condensate through the increased exposure to air inherent in the wicking pad.

12. The barrier device according to claim 2, additionally comprising a continuous wall projecting upward at or near the interior edge of the platform, whereby the continuous wall serves to contain condensate.

13. The barrier device according to claim 1, additionally comprising a continuous wall projecting upward at or near the interior edge of the platform, whereby the continuous wall serves to contain condensate.

14. The barrier device according to claim 13, additionally comprising a wicking pad positioned on the top side of the platform, between the inner partition and the continuous wall, wherein the wicking pad receives the condensate and accelerates evaporation of the condensate through the increased exposure to air inherent in the wicking pad.

15. The barrier device according to claim 14, additionally comprising at least one agent applied to the wicking pad selected from the group consisting of mold inhibiting, mold killing, bacteriostatic, and bacteriocidal agents.

16. The barrier device according to claim 14, wherein said platform extends sufficiently into the airflow from said air delivery structure to direct air across the wicking pad to evaporate the condensate.

17. The barrier device according to claim 1, additionally comprising an air delivery structure integrally attached to form a single structure, whereby when the single structure is installed into a ceiling having adjacent ceiling structures, the barrier device surrounding the air diffuser prevents condensate from the air delivery structure from contacting the adjacent ceiling structures.

18. The barrier device according to claim 17, additionally comprising a deflecting partition, extending downwardly, selectively from said platform or from said air diffuser structure, said deflecting partition oriented substantially perpendicular to said ceiling, such that said deflecting partition deflects airflow to prevent dirt, dust, grease, moisture droplets, and other particulates in said airflow from depositing onto the adjacent components of the ceiling, whereby when the article of manufacture is installed into a ceiling having adjacent ceiling structures, the barrier device surrounding the air diffuser structure prevents condensate from the air delivery structure from contacting the adjacent ceiling structures, and the deflecting partition deflects airflow from the adjacent ceiling structures.

19. A barrier means for preventing contact of condensate that collects about external edges of an air delivery structure with ceiling materials, which comprises a unitary device of substantially square or rectangular circumference, said barrier means comprising a first upward sealing edge spaced apart from the external edges of the air delivery structure, a bottom edge of said upward sealing edge contoured to indent toward and under said external edges of said air delivery structure, forming a second substantially horizontal sealing edge beneath said external edges, so as to come into intimate contact with an underside portion of said external edges, and further comprising a third, downward sealing edge extending downward from the horizontal sealing edge interior to a ceiling structure supporting said air delivery structure, to ensure that any condensate that seeps from an upper portion of said air delivery structure is directed away from contact with the adjacent ceiling materials.

20. A method of preventing exposure to condensation from an air delivery structure to ceiling components adjacent to the air delivery structure, comprising the steps of:

a) fabricating a water-impermeable barrier device comprising (1) an inner partition substantially perpendicular to a ceiling, said inner partition having a top edge and a bottom edge, said inner partition surrounding the external edges of said air delivery structure; and (2) a platform integral with said inner partition, said platform substantially horizontal to the ceiling, having an exterior edge at or beyond a mating junction with the inner partition bottom edge, and an interior edge at or interior to a ceiling support structure supporting the air delivery structure, and an intermediate section spanning between the exterior and interior edges of the platform; and b) inserting said fabricated barrier device between the support structure and the air delivery structure, whereby upon said inserting the barrier device provides a water-impermeable barrier that prevents the condensation from passing to the ceiling components adjacent to the air delivery structure.

21. The method according to claim 20, wherein the barrier device additionally comprises a deflecting partition integral with the platform, extending downward from said platform, said deflecting partition positioned substantially perpendicular to said ceiling, whereby said deflecting partition deflects airflow to prevent dirt, dust, grease, moisture droplets, and other particulates in said air airflow from depositing onto the adjacent components of the ceiling.

22. A kit for installation of a barrier device between an air-conditioning unit's air delivery structure, said air delivery structure having external edges, and adjacent components of a ceiling, comprising:

a) instructions that provide steps for installation of the barrier device; and b) one or more units of the barrier device, each unit comprising:

1) an inner partition substantially perpendicular to a ceiling, said inner partition having a top edge and a bottom edge, said inner partition surrounding the external edges of said air delivery structure; and 2) a platform integral with said inner partition, said platform substantially horizontal to the ceiling, having an exterior edge at or beyond a mating junction with the inner partition bottom edge, and an interior edge at or interior to a ceiling support structure supporting the air delivery structure, and an intermediate section spanning between the exterior and interior edges of the platform;

whereby upon installation the inner partition and the platform internal to the mating junction prevent condensation from the air delivery structure from contacting the surrounding support framework of the ceiling.

23. The kit according to claim 22, wherein the barrier device additionally comprises a deflecting partition integral with the platform, extending downward from said platform, said deflecting partition positioned substantially perpendicular to said ceiling, whereby said deflecting partition deflects airflow to prevent dirt, dust, grease, moisture droplets, and other particulates in said air airflow from depositing onto the adjacent components of the ceiling.

* * * * *